US005237942A

United States Patent [19]

Satoma

[11] Patent Number: 5,237,942

[45] Date of Patent: Aug. 24, 1993

[54] OVERLOCK SEWING MACHINE HAVING UPPER AND LOWER LOOPER THREAD TAKEUP LEVER DRIVE MECHANISMS

[75] Inventor: Shiro Satoma, Chofu, Japan

[73] Assignee: Juki Corporation, Tokyo, Japan

[21] Appl. No.: 843,310

[22] Filed: Feb. 28, 1992

[30] Foreign Application Priority Data

Mar. 1, 1991 [JP] Japan ..... 3-35987

[51] Int. Cl.[5] ..... D05B 1/20; D05B 1/14; D05B 49/00

[52] U.S. Cl. ..... 112/162; 112/168; 112/246; 112/199

[58] Field of Search ..... 112/162, 168, 246, 241, 112/197, 199, 200, 166, 302

[56] References Cited

U.S. PATENT DOCUMENTS 4,690,080 9/1987 Mikuni et al. ..... 112/168 X
4,967,677 11/1990 Seiriki et al. ..... 112/168
4,970,967 11/1990 Kitai et al. ..... 112/168 X

FOREIGN PATENT DOCUMENTS 61-31082 2/1986 Japan .
61-181488 8/1986 Japan .

OTHER PUBLICATIONS

Union Special Catalog, "Stitch Formation Type 401", p. 7.
Union Special Catalog, "Overedge Stitch Formation Type 504", copyright 1978, p. 24.
Union Special Catalog, "Stitch Formation Type 605", Copyright 1971, pp. 26–27.

*Primary Examiner*—Clifford D. Crowder
*Assistant Examiner*—Paul C. Lewis
*Attorney, Agent, or Firm*—Morgan & Finnegan

[57] ABSTRACT

An overlock sewing machine which is arranged such that a lower thread take-up lever is disposed independently of an upper looper thread take-up lever and that a lower looper thread take-up lever drive mechanism is fabricated independently of an upper thread take-up lever drive mechanism and adapted to connect thereto an adjust means for adjusting the amount of thread fed from the lower looper thread take-up lever.

5 Claims, 5 Drawing Sheets

OVERLOCK SEWING MACHINE HAVING UPPER AND LOWER LOOPER THREAD TAKEUP LEVER DRIVE MECHANISMS

BACKGROUND OF THE INVENTION

This invention relates to an improvement on an overlock sewing machine, and more particularly to an overlock sewing machine which pays out or feeds threads for various stitch shapes in association with the conversion of stitches, such as an overedge stitch, a double chain stitch and the like.

Japanese Laid-Open Utility Model Application Sho 61-31082 describes an overlock sewing machine for producing the various aforementioned stitch formations. The described overlock sewing machine adjusts the amount of feed thread by changing the position of a thread guide, which is so arranged to cooperate with a conversion from, for instance, the overedge stitch to the double chain stitch. Feed thread adjustment by an eccentric cam is described in Japanese Laid-Open Patent Application Sho 61-181488.

The above prior art references, however, include disadvantages in that the sewing machines do not accommodate the various stitch formations. More specifically, it is difficult to adjust the amount of feed thread to obtain the desired stitch formation since the aforementioned conventional sewing machines using the aforementioned thread guide and eccentric cam are not capable of varying the amount of feed thread, that is, whereas a large amount of feed threads is required for overedge stitching, a small amount of feed threads is required for roll hem stitching. In the aforementioned two publications, the amount of feed threads is not suitably adjustable by the described thread guide or eccentric cam.

SUMMARY OF THE INVENTION

It is, therefore, an object of the present invention to provide an overlock sewing machine which is configurated to overcome the aforementioned disadvantages inherent in the prior art.

Another object of the invention is to provide an overlock sewing machine, which is adapted for rotating a stitch change manual dial, thereby adjusting the amount of lower looper feed thread according to various stitch formations.

A further object of the invention is to provide an overlock sewing machine, which is designed for feeding threads in large or small amounts and to conform to various and different stitching formations.

In accordance with the present invention, an overlock sewing machine is arranged so that a lower looper thread take-up lever is disposed independently of an upper looper thread take-up lever, and that a lower looper thread take-up lever drive mechanism is fabricated independently of an upper looper thread take-up lever drive mechanism, and that the lower looper thread take-up lever drive mechanism is provided with an adjust means adapted to adjust the amount of feed thread from the lower looper thread take-up lever. This ensures precise application of threads to any stitch formation.

According to the present invention, the lower looper thread take-up lever is swung by the lower looper thread take-up lever drive mechanism, whereas the upper looper thread take-up lever is swung independently of the lower looper thread take-up lever by the upper looper thread take-up lever drive mechanism. The adjust means serves to adjust the amount of thread fed from the lower thread take-up lever.

The objects of the invention are accomplished by disposing the lower looper thread take-up lever independently of the upper looper thread take-up lever, fabricating the lower looper thread take-up lever drive mechanism independently of the upper looper thread take-up lever drive mechanism, and connecting an adjust means to the lower looper thread take-up lever drive mechanism for adjusting the amount of feed thread from the lower looper thread take-up lever.

BRIEF DESCRIPTON OF THE DRAWINGS

FIG. 5 is a diagrammatic view showing a relationship between the basic components to each other when sewing is performed by overedge stitching or the like.

DETAILED DESCRIPTION OF THE DRAWINGS

Figure 1:
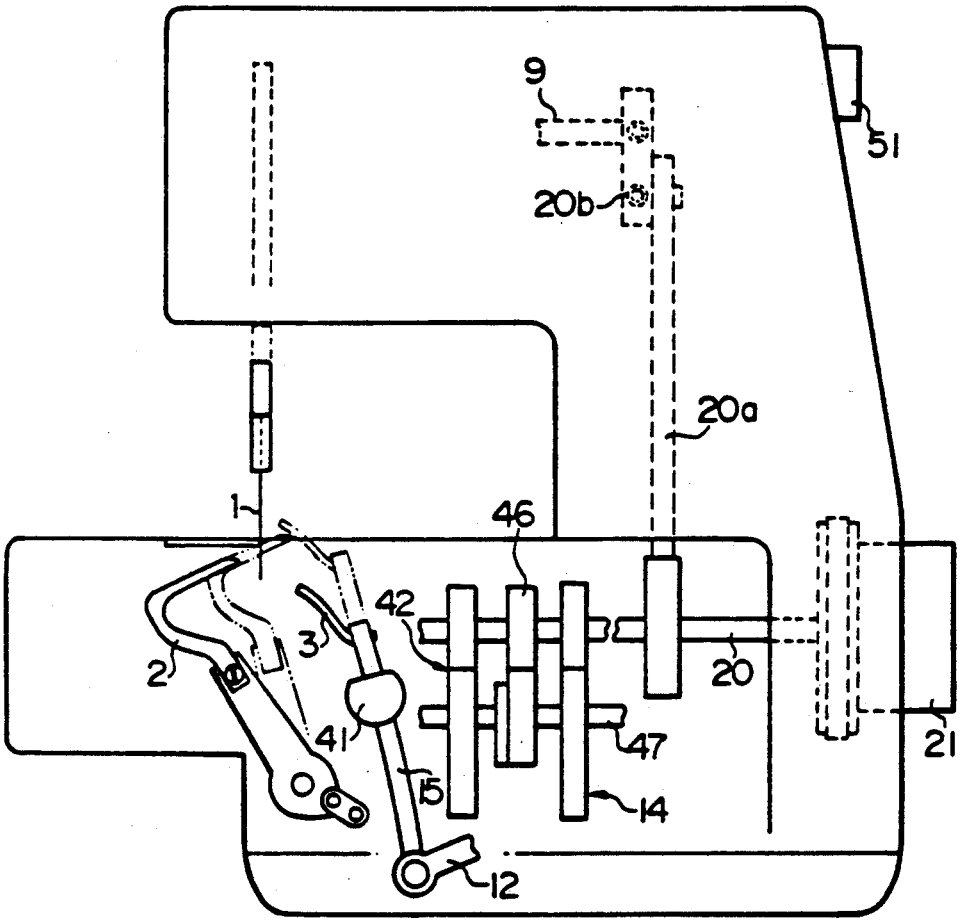
FIG. 1 is a front view showing an overlock sewing machine according to the present invention.

Referring to FIG. 1, there is shown an overlock seWing machine according to the present invention, which is provided with a needle 1, an upper looper 3, and a lower looper 2 arranged downwardly of the needle.

Figure 2:
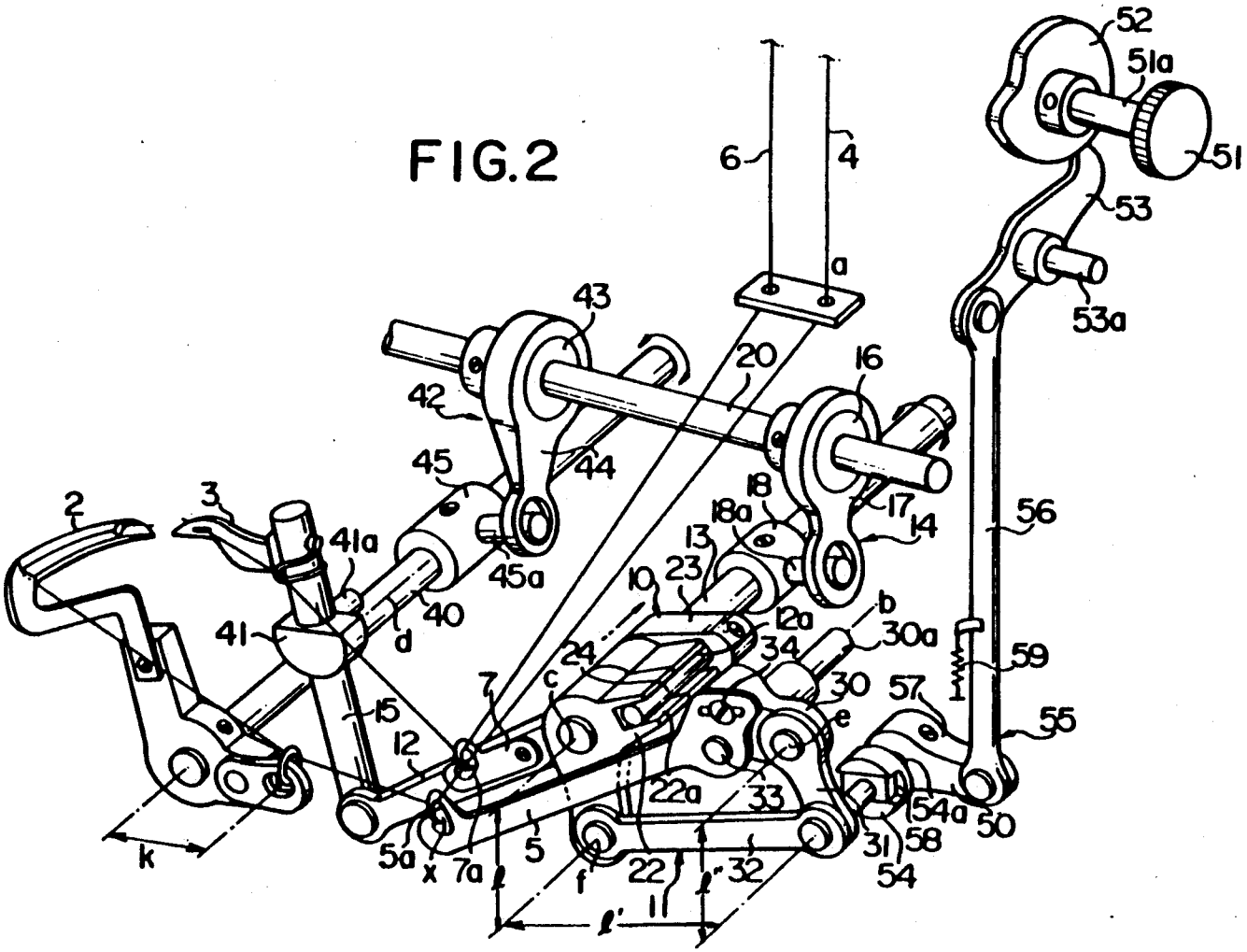
FIG. 2 is a perspective view showing upper and lower looper thread take-up lever drive mechanisms, and an adjust means as incorporated in the overlock sewing machine according to the present invention.

As shown in FIG. 2, a lower looper thread 4 is engaged with the lower looper 2 and tensioned by a lower looper thread take-up lever 5. On the other hand, an upper looper thread 6 is engaged with the upper looper 3 and tensioned by an upper looper thread take-up lever 7.

The upper and lower loopers 3 and 2 are adapted to cooperate with the needle 1 to make the various stitch formations.

In this instance, it is noted that the lower looper thread take-up lever 5 is disposed independently of the upper looper thread take-up lever 7.

The upper and lower looper thread take-up levers 7 and are driven by upper and lower looper thread take-up lever drive mechanisms 10 and 11, respectively, Which are fabricated independently of each other.

The upper looper thread take-up lever drive mechanism 10 comprises an upper looper drive arm 12 which serves to support the upper looper thread take-up lever 7, an upper looper shaft 13 on which the first arm 12 is carried, and a swing means 14 adapted to swing the upper looper shaft. More specifically, the upper looper drive arm 12 has a first end which is rotatably oonnected to an upper looper slide shaft 15 and a second end which is loosely fitted over the upper looper shaft 13 and provided with a forked member 12*a*. The upper looper thread take17 up lever 7 is screwed to the upper looper drive arm 12. The upper looper thread take-up lever 7 includes a thread guide 7a for passing the upper looper thread 6 therethrough. The swing means 14 comprises an eccentric cam 16 fixed to a main shaft 20 of a sewing machine, an upper looper drive rod 17, and an upper 1ooper drive member 18. The main shaft 2o is driven by a motor 21 (FIG. 1). The upper looper drive rod 17 is adapted to loosely receive therein at a first end thereof the eccentric cam 16. The upper looper drive member 18 includes an arm 18a which is rotatably connected to a second end of the upper looper drive rod 17. The upper looper drive member 18 is fixed to the upper looper shaft 13. Consequently, when the main shaft 20 is rotated, the upper looper shaft 13 permits its reciprocal rotation about its axis. A connecting arm 22 for swinging the upper looper is rigidly mounted on a first end of the upper looper shaft. With this arrangement, the swing connecting arm is reciprocally swung as the upper looper shaft is reciprocally rotated. The connecting arm 22 is disposed adjacent to the upper looper drive arm 1z and has a first end which is formed with a forked member 22a, which is similar to the forked member 12a of the upper looper drive arm 12.

The upper looper shaft 13 carries thereon an upper looper release arm 23 which is slidably and rotatably fitted longitudinally thereof and which is provided with a pin 24 fixed thereto. As shown in FIG. 2, the pin is adapted for engagement with both of the forked member 12a of the upper looper drive arm 12 and the forked member 22a of the swing connecting arm 22. The upper looper release arm 23 is slidably moved by a movable mechanism (not shown) on the upper looper shaft. The upper looper release arm 23 is movable between a stop position where the pin 24 is engaged simultaneously in the both of the forked members 12a and 22a of the upper looper drive arm 12 and the swing connecting arm 22, and a release position where the pin 24 is released from the forked member 22a of the swing connecting member 22. In the stop position, the upper looper drive arm 12 is subjected to movement of the upper looper shaft by the swing connecting arm 22. However, in the release position, movement of the upper looper shaft is not transmitted to the upper looper drive arm 1z since the pin in the release position is released from the forked member 22a of the swing connecting rod 22 to thus impart no movement thereof to the upper looper drive arm.

The lower looper thread take-up lever drive mechanism 11 comprises a support link 3o for supporting the lower looper thread take-up lever 5, a take-up lever connecting link 31 connected to the support link, and a take-up lever drive link 32 for connecting the take-up lever connecting link to the swing connecting arm 22. More specifically, the base end of the lower looper thread take-up lever 5 is secured to one end of the support link 30 by a fixed shaft 33 and a screw 34. The support link 30 is adapted to have its shaft 30a rotatably mounted to a frame of the sewing machine (not shown). The take-up lever connecting link 31 is adapted to have its end pivoted to the other end of the support link 30. A first end of the take-up lever drive link 32 is pivoted to a second end of the take-up lever connecting link 31. The second end of the take-up lever drive link 32 is pivotally mounted to a second end of swing connecting rod 22, viz., to the end opposed to the forked member 22a.

The lower looper thread take-up lever 5 is provided at its free end with a thread guide 5a to which the lower looper thread 4 is applied.

Accordingly, swinging movement of the swing connecting arm 22 is transmitted by the take-up drive link 32, take-up lever connecting link 31, and the support link 30 to the lower looper thread take-up lever 5. The lower looper thread take-up lever 5 is swung as the upper looper swing connecting rod 22 is swung.

The lower looper 2 is fixed to the lower looper shaft 40 while the upper looper 3 is secured to the upper end of the upper looper slide shaft 15, the lower end of which is pivotally mounted on one end of the upper drive arm 12 as aforementioned. The upper looper slide shaft 15 is slidably supported on an upper looper slide bracket 41, a shaft 41a of which is rotatably supported on the frame of the SeWing machine (not shown).

The lower looper shaft 4o is caused to swing by another swing means 42 via the main shaft 20. More specifically, this swing means is fabricated similar to the aforementioned swing means 14 and comprises an eccentric cam 43 fixed to the main shaft, a lower looper drive rod 44, one of which is adapted to loosely receive therein the eccentric cam, and a lower looper drive member 45 rigidly mounted on the lower looper shaft 40. The lower looper drive member includes an arm 45a which is rotatably supported on the other end of the lower looper drive rod 44. Consequently, rotation of the main shaft 20 is converted by the eccentric cam 43, lower looper drive rod 44, and the lower looper drive member 45 to a reciprocal swing movement, thereby imparting reciprocal rotation about the axis of the lower looper shaft.

For this reason, when sewing is performed by overedge stitching or roll hem stitching, the upper looper release arm 23 is located in the stop position to thus rotate the main shaft 20 to swing the upper looper thread take-up lever 7 and the lower looper thread take-up lever 5. On the other hand, the upper looper 3 is swung while moving up and down by swing movement of the upper looper drive arm 12 whereas the lower looper 2 is swung by swing movement of the lower looper shaft 40. In this manner, the upper and lower loopers are caused to cooperate with the needle to obtain stitches.

For the sewing operation when performed by double chain stitching or flat seam stitching, the upper looper release arm 23 is in the release position to render the upper looper stationary in its lowermost position. In this instance, the lower looper is swung and moved front and back to cooperate with the needle thereby attaining stitches.

In this instance, it is noted that an adjust means 50 is connected to the lower looper thread take-up lever drive mechanism 11. This adjust means functions to adjust the amount of feed thread from the lower looper thread take-up lever according to the stitch formation. In the illustrated embodiment, the adjust means 50 includes those stitch formations which change position when the take-up lever connecting link 31 of the lower looper thread take-up lever drive mechanism 11 is inclined. More specifically, the adjust means comprises a stitch change or conversion manual dial 51, a cam 52 rotated by the dial, a follower 53 in contact with the cam, a take-up lever adjuster 54 connected to the take-up lever connecting link 31, and link means 55 adapted for connecting the follower 53 to the take-up adjuster 54.

The stitch change or conversion manual dial 51 is mounted, for instance, on the rear end of the head of the sewing machine, as shown in FIG. 1. The cam 52 is fixed to a shaft 51*a* of the stitch change or conversion manual dial 51. The follower 53 takes a lever form and includes a support shaft 53*a* substantially at the center of the follower 53, where the support shaft 53*a* is rotatably supported on the frame of the sewing machine. The follower 53 includes a first end which is in contact with the periphery of the cam 52.

A link means 55 includes a connecting bar 56, a first end of which is pivoted to a second end of the follower 53, and a drive arm 57. The drive arm 57 has a first end pivoted to a second end of a connecting arm 56 and a second end of drive arm 57 is fixed to a shaft 54*a* for the take-up lever adjuster 54. A square block 58 is extended from the take-up lever connecting link and fitted in a groove formed in the take-up lever adjuster 54.

A spring 59 is provided to urge the connecting arm 56 downward to allow the first end of the follower 53 to contact with the cam 52 at all times.

With the aforementioned arrangement, upon rotating the stitch change or conversion manual dial 51, cam 52 is rotated to change the tilt of the adjuster 54, that is, the angles at which the adjuster is rotated depend upon the curve of the cam 5z, so that the take-up lever connecting link 31 may change its tilt by the square block 58, thereby varying the angle at which the lower looper thread take-up lever is tilted to form various angles. This will change the amount of thread fed from the lower looper thread take-up lever. In this connection, it is noted that if the amount of rotation of the stitch change or conversion manual dial and the curve to be described by the cam are pre-set to conform with the stitch formation, the required amount of feed thread may be obtained for each stitch formation. The dial is preferably graduated (not shown) to render the amount of rotation of the dial readily readable. The amount of lower looper feed thread required by each stitch formation is shown, by way of example, as follows:

| | |
|---|---|
| overedge stitch | 13 mm |
| double chain stitch | 8 mm |
| roll hem stitch | 2 mm, and |
| flat seam stitch | 23 mm |

Figure 3:
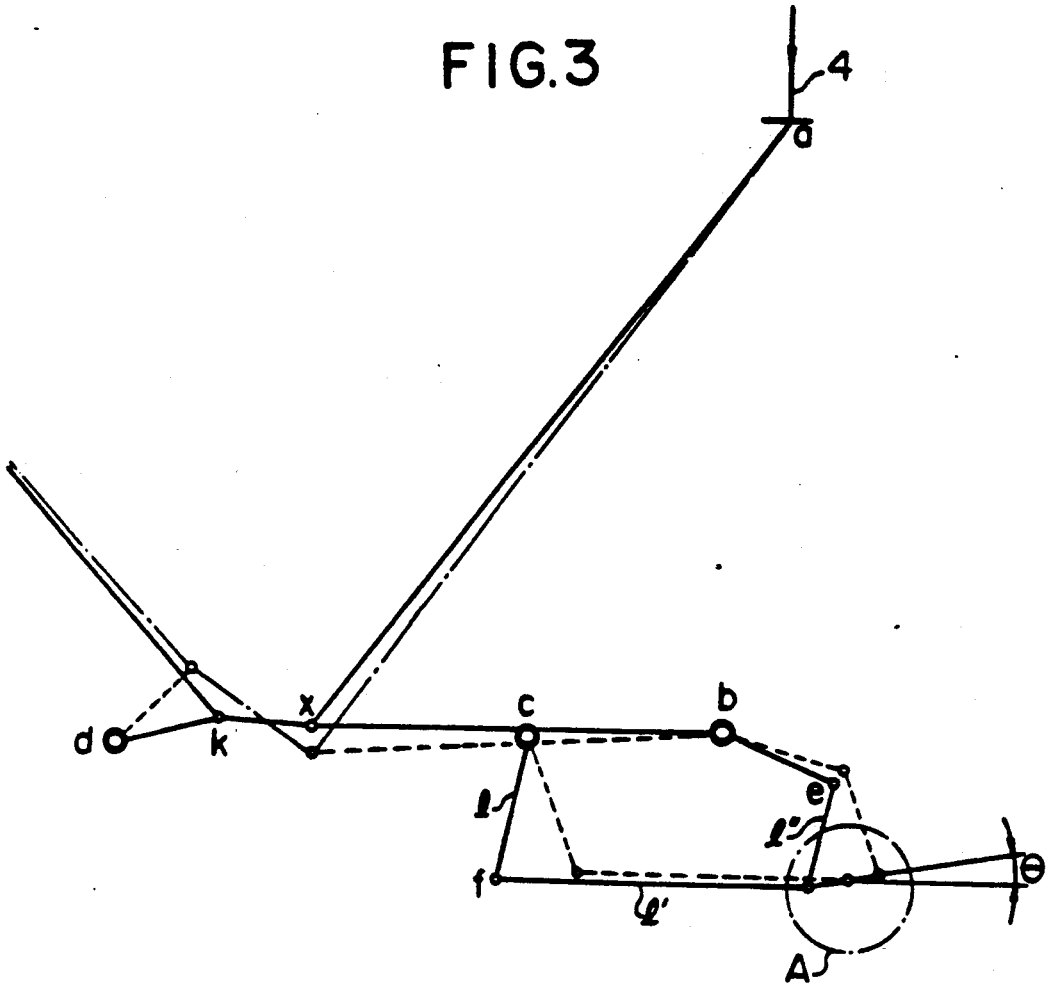
FIG. 3 is a diagrammatic view showing a relationship between the basic components to each other when sewing is performed by double chain stitching and roll hem stitching.
Figure 4:
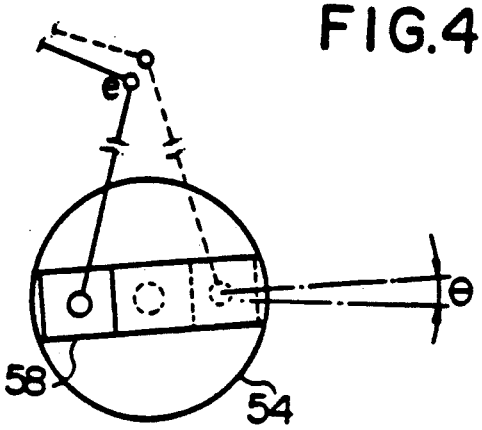
FIG. 4 is a presentation showing, in an enlarged scale, of a portion A which is encircled in FIG. 3.
Figure 5:
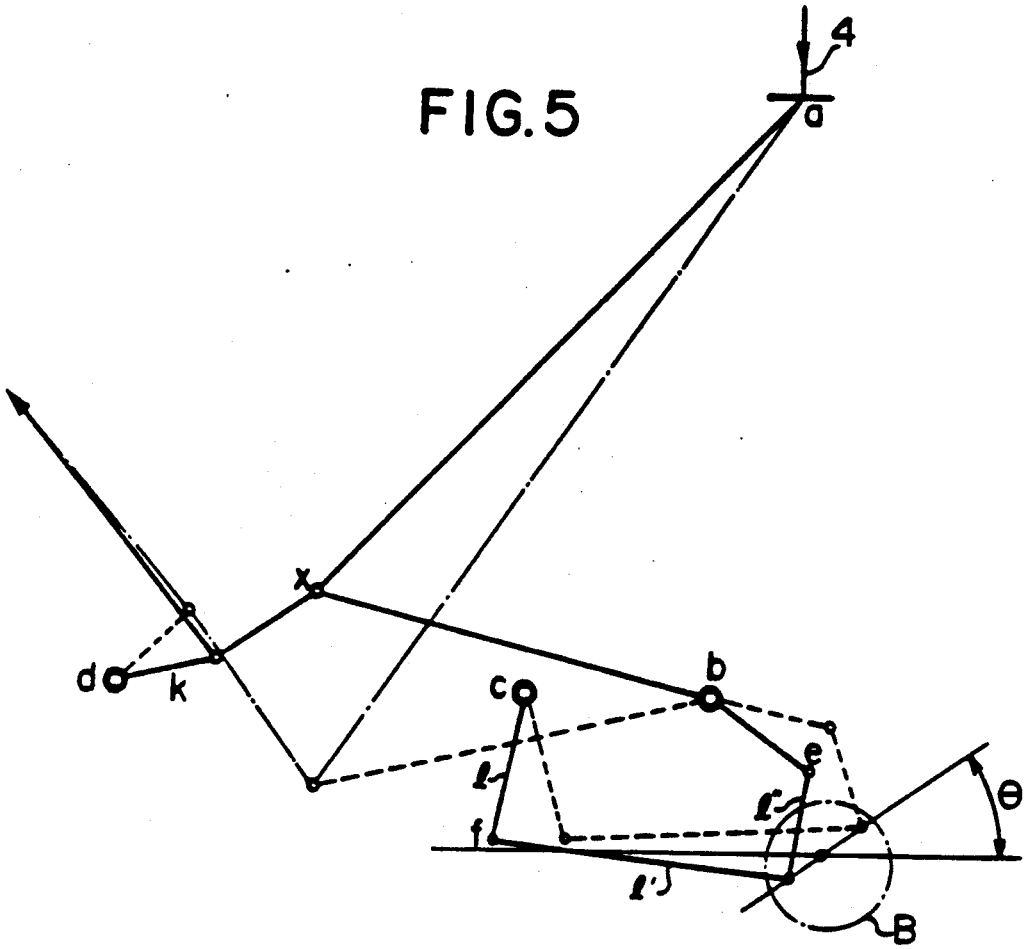
Figure 6:
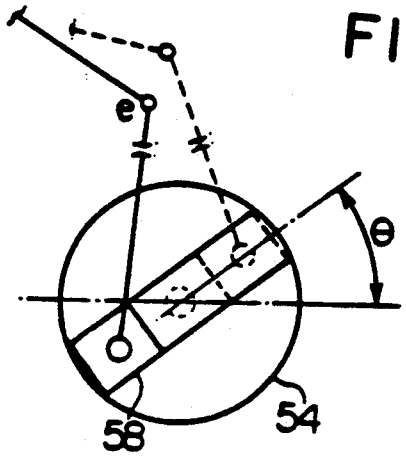
FIG. 6 is a presentation showing, in an enlarged scale, of a portion B which is encircled in FIG. 5.
Figure 7:
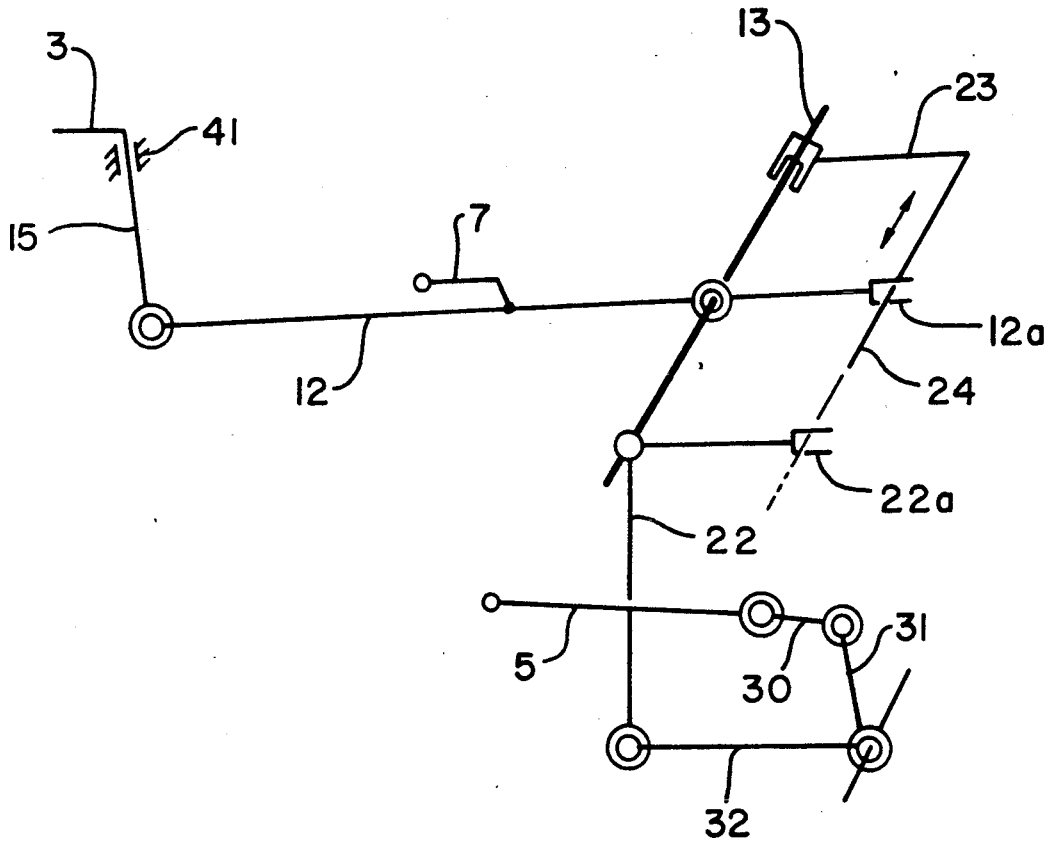
FIG. 7 is a schematic presentation showing upper and lower looper thread takeup lever drive mechanisms.

FIG. 3 is a diagrammatic view showing a positional relationship between the basic components in association with the production of double chain stitches or roll hem stitches, which require less lower looper feed thread. FIG. 4 is another diagrammatic view showing a positional relationship between the basic components in association with the production of overedge stitches or flat seam stitches, which require more lower looper feed thread.

When the take-up lever adjuster 54 (FIG. 3) is tilted slightly, a pivot axis e of the take-up lever connecting link is changed, which changes a tip point x of the lower looper thread take-up lever 5 (FIG. 2) to correspond to the change of the axis e. It should be understood therefrom that a lesser amount of change of the pivot axis e involves a corresponding lesser amount of change of the pivot axis x. In other words, less change of the tip point x causes less change in the dotted lines with respect to the solid line. This requires a lesser amount of feed threads. Reference letters which are used in FIG. 2 designate like corresponding axes and points throughout FIGS. 3, 4, 5, and 6.

I claim:

1. An overlock sewing machine comprising:

a lower looper thread take-up lever;

an upper looper thread take-up lever, wherein said lower looper thread take-up lever is disposed independently of said upper looper thread take-up lever;

a lower looper thread take-up lever drive means for swinging said lower looper thread take-uplever;

an upper looper thread take-up lever drive means for swinging said upper looper thread take-up lever independently of said lower looper thread take-up lever independently of sid lower looper thread take-up lever by said upper looper thread take-up lever drive means; and an adjusting means attached to said lower looper thread take-up lever drive means, wherein said adjusting means adjusts an amount of thread fed from said lower looper thread take-up lever.

2. AN overlock sewing machine comprising:

an upper looper supplied with an upper looper thread and a lower looper supplied with a lower looper thread;

a main shaft;

motor means;

a linkage means linking said motor means and said main shaft so that the main shaft is rotated by the motor means;

an upper looper drive means linked to said upper looper and said main sahft for driving said upper looper responsive to movement of said main shaft;

a lower looper drive means linked tos adi lower looper and said main shaft for driving said lower looper responsive to movement of said main shaft;

a first take-up member connected to said upper looper drive means for engaging with said upper looper thread to take out said thread;

a second take-up member for engaging with said lower looper thread to take out said thraed, wherein said second take-up member is driven by said main shaft independently from said first take-up member; and an adjusting means connected to said second take-up member for controlling the drive of said second take-up member, whereby said second take-up member takes out a predetermined value of said lower looper thread depending on the selected stitch formation.

3. An overlock sewing machine as claimed inc laim 2, further comprising:

a driving mechanism linking said second take-up member and said main shaft for driving said second take-up member by movement of said main shaft; and a release means connected to said upper looper drive emans for disengaging the linkage between said first take-up member and said main shaft.

4. An overlock sewing machine as claimed in claim 2, further comprising;

a driving mechanism linking said main shaft to said first take-up member and said upper looper; and a release means connected to said upper looper drive means for disengaging the linkage between said main shaft and said first take-up member.

5. An overlock sewing machine as claimed in claim 2, further comprising:

a driving mechanism linking said upper looper drive means to said first take-up member and said upper looper; and a release means connected to said upper looper drive means for disengaging the linkage between said upper looper drive means and said first take-up member.

* * * * *